US006386389B1

(12) United States Patent
Percy et al.

(10) Patent No.: US 6,386,389 B1
(45) Date of Patent: May 14, 2002

(54) VENDING MACHINE ACCESS PANEL AND METHOD OF FORMATION

(75) Inventors: Charles W. Percy, Chesterfield; Jack L. Osborn, St. Louis, both of MO (US)

(73) Assignee: Crane Co., Stamford, CT (US)

( * ) Notice: Subject to any disclaimer, the term of this patent is extended or adjusted under 35 U.S.C. 154(b) by 0 days.

(21) Appl. No.: 09/545,016

(22) Filed: Apr. 7, 2000

(51) Int. Cl.[7] ..... A47F 1/04
(52) U.S. Cl. ..... 221/155; 40/611
(58) Field of Search ..... 221/155, 282, 221/1, 92, 131, 191; 312/204, 234, 114; 40/611, 575, 781

(56) References Cited

U.S. PATENT DOCUMENTS

| | | | | |
|---|---|---|---|---|
| 2,726,026 A | | 12/1955 | Gould et al. | 226/46.4 |
| 3,269,595 A | | 8/1966 | Krakauer et al. | 221/75 |
| D290,142 S | | 6/1987 | Morgan, Jr. et al. | D20/5 |
| D292,420 S | | 10/1987 | DelPercio et al. | D20/4 |
| 4,919,250 A | * | 4/1990 | Olson et al. | 194/248 |
| 5,255,968 A | * | 10/1993 | Craven | 312/234 |
| 5,335,818 A | | 8/1994 | Maldanis et al. | 221/131 |
| D364,646 S | | 11/1995 | Maldanis | D20/4 |
| 5,509,225 A | | 4/1996 | Minh et al. | 40/611 |
| 5,598,655 A | | 2/1997 | McGarrah | 40/611 |
| 5,778,582 A | * | 7/1998 | Rath | 40/611 |

* cited by examiner

*Primary Examiner*—Kenneth W. Noland
(74) *Attorney, Agent, or Firm*—Hughes & Luce, L.L.P.

(57) ABSTRACT

Access panel and method of manufacture. The access panel is mounted on a vending machine for movement between open and closed positions and normally closes the opening to a product retrieval area. Advertising indicia is provided behind a front face of the access panel to prevent damage to the indicia. The access panel is also tamper resistant and may be changed only by authorized personnel. The advertising indicia is encapsulated between a front panel and back panel of the access panel.

22 Claims, 4 Drawing Sheets

VENDING MACHINE ACCESS PANEL AND METHOD OF FORMATION

BACKGROUND OF THE INVENTION

The invention relates to an access panel, and the formation thereof, for a vending machine. The access panel is movable between open and closed positions and can provide access areas of vending machines including dispensed items and also security from theft of items stored in certain vending machines. The access panel includes an outer panel portion and an inner panel portion with advertising indicia between the panels and viewable by a consumer thru the outer panel.

Vending machines are well known and are available in several styles. Drink dispensers can dispense drinks in cups or prefilled containers, e.g., canned soda. Many drink dispensers are specific to the products of one company and the entire front panel is oftentimes devoted to advertising the products of that company. Vending machines may also dispense prepackaged ingestible products, such as candy bars, chips, chewing gum, cookies, crackers, etc. Such vending machine typically have a front door with a large window for viewing of the products available inside for dispensing. A product selector is also provided to select the desired product by matching the product and a product selection button. The selected product is then fed from a magazine storing the product to a product retrieval area located at the bottom of the vending machine. The product mix is generally large and is frequently changed in such machines depending on product sales, availability, profit margin, etc. Such machines have little if any room for effectively advertising products because of the need for the large product viewing window. Because of the changing nature of the products in the machine, dedicated advertising cannot be provided without changing major components of the vending machine. Typically, it is desirable to have as much of the machine as possible with advertising indicia to attract consumer attention or to provide advertising at eye level to also attract consumer attention to the advertising to encourage the sale of one brand over another brand. With vending machines having large product viewing windows and many different products inside, effective space for changeable advertising has not been considered as being available.

Decals or the like could be applied to such vending machines. Although decals can be changed from time to time to change advertiser, they are easily damaged and can be removed or changed without authorization. Advertising could be applied, for example by printing or painting, to the exterior of the vending machine. It too can be easily damaged and it would be difficult and expensive to change. The size and location of such advertising indicia though is limited without obscuring the view of the products for sale in window type vending machines.

There is thus a need for vending machines that can advertise products in a way that will attract consumer attention to the product yet have advertising that is not easily damaged or removed without authorization and can be changed without major expense or modification of the vending machine.

The present invention provides advertising indicia that will be seen by a large number of machine users to encourage buying a particular brand or product. The indicia can be easily changed without major expense, is resistant to damage and cannot be easily removed or changed without authority.

SUMMARY OF THE INVENTION

Among the several objects and features of the present invention may be noted the provision of a vending machine that can be used to display changeable advertising; the provision of such a vending machine that includes advertising that can be easily and inexpensively changed; the provision of such a vending machine that includes advertising that is damage resistant; the provision of such a vending machine that includes advertising at a location that is easily seen by consumers but does not obscure viewing of the products in the vending machine; the provision of a vending machine that has the advertising indicia as part of the product access door (access panel); and the provision of such a door that has the advertising behind the outer surface to protect the advertising from wear, abuse and unauthorized access; and the provision of such a door that can be easily made and changed.

An aspect of the present invention is the provision of a vending machine for the dispensing of packaged products such as drinks, confections and food. The vending machine has a movable access panel providing access to an internal area of the machine by a person, the access panel being located such that a machine user is likely to view the access panel during operation of the machine. The vending machine includes an enclosure securely enclosing product to be selectively purchased by a consumer. A plurality of feed mechanisms are each operable to selectively dispense product to a product access area where the consumer can access the dispensed product for subsequent use. A product selection device is associated with the feed mechanism and usable by the consumer to select the product desired for dispensing. An access panel is movable between closed and open positions adjacent to the product access area, the panel having a portion visible in the closed position to a consumer. The panel has advertising indicia behind an outer disposed surface of the visible portion of the panel and viewable therethrough by a consumer when the panel is in its closed position.

Another aspect of the invention is the provisions of a method of forming an access panel for a vending machine. The method includes forming an outer panel of material that allows viewing therethrough, said outer panel having an outer surface and an inner surface and a contour. Applying advertising indicia to at least a portion of the inner surface. Forming an inner panel and securing it in overlying relation to the advertising indicia thereby to have said advertising indicia between the inner and outer panels.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
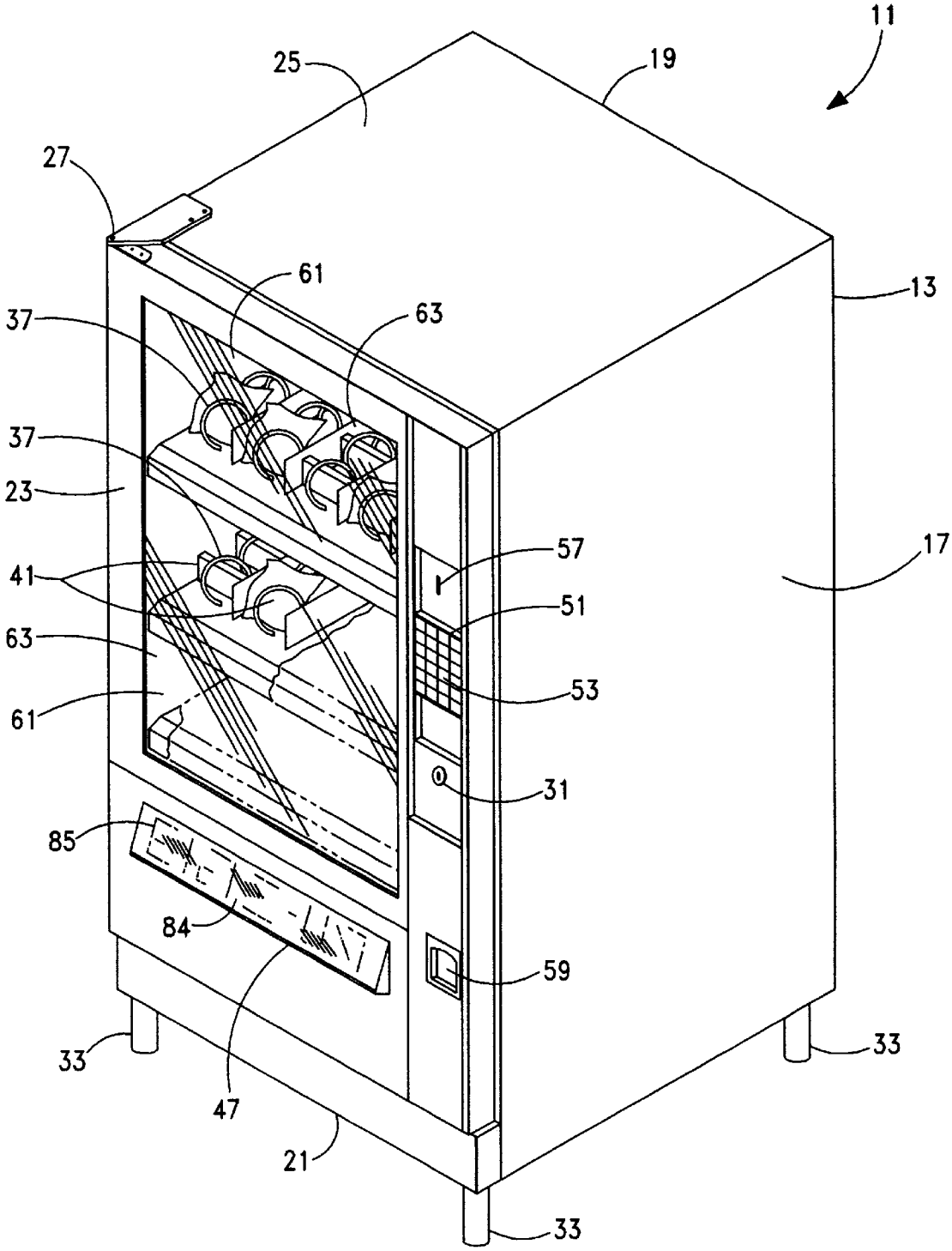
FIG. 1 is a perspective of a vending machine as viewed from the front of the vending machine.
Figure 2:
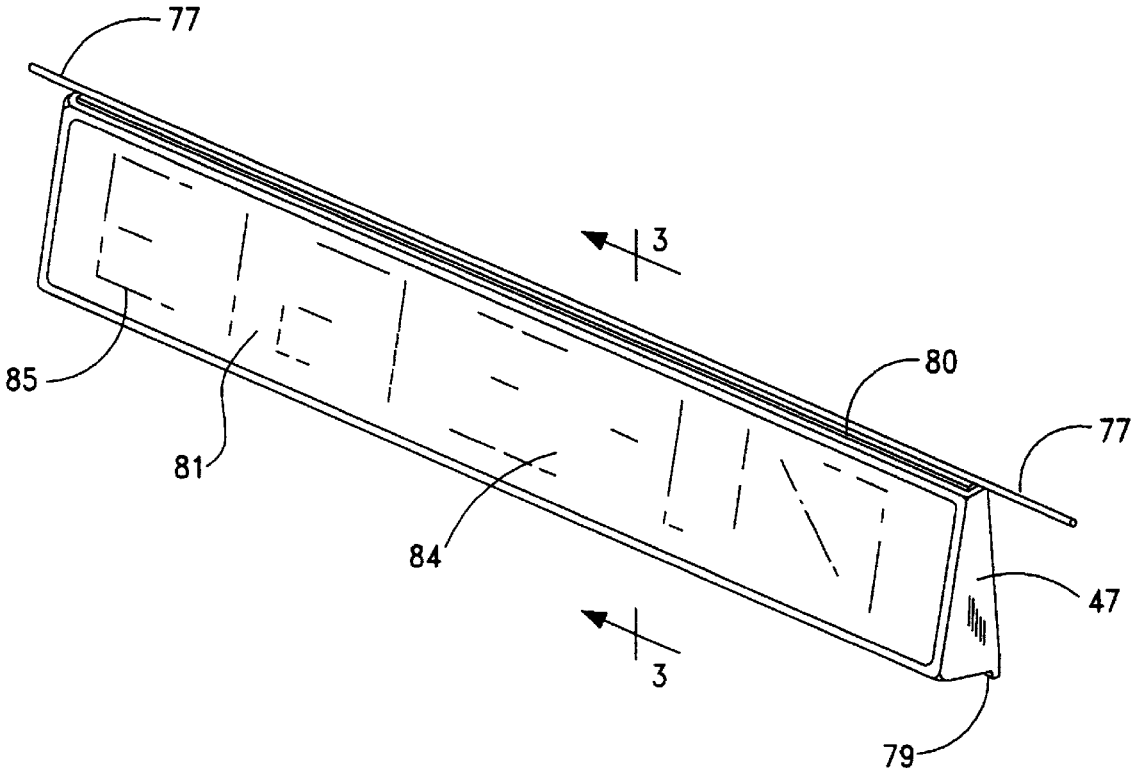
FIG. 2 is an enlarged perspective of a movable panel that provides access to dispensed product and helps provide security from product theft.

The reference numeral 11 designates generally a vending machine, FIG. 1. The machine includes an enclosure 13 comprising two side walls 15, 17, back wall 19, bottom wall 21, door (front wall) 23 and top wall 25. The door 23 is hinged at 27 for selective movement between open and closed positions to provide access to the interior for replenishing or changing the products inside. The door 23 of the illustrated embodiment of vending machine 11 comprises a front face of the machine. The door 23 can be locked in the closed position by a lock 31. The enclosure 13 can be supported by a plurality of legs 33 which may be adjustable for leveling of the machine.

A plurality of product feeders 37 are mounted inside the enclosure 13 and are operable to selectively store and feed packaged product 41. Many types of product feeders 37 are known and a rotatable helical screw type is shown as illustrative. Rotation of a feeder 37 will advance a packaged product 41 forward to a position where it will fall from the feeder down to a product access or retrieval area 43 behind an access panel (door) 47.

The vending machine 11 is provided with a product selector 51 on the door 23. The selector 51 can be in the form of a keypad with pushbuttons 53 operably connected to an electronic controller (not shown) as are known in the art. Generally, each feeder 37 has a product code such as alpha and/or numeric characters positioned thereby. By pressing the button(s) 53 with the appropriate coding, the respective feeder 37 will be actuated for dispensing the product therefrom. The vending machine 11 is also provided with a money deposit 57. Prior to selecting the desired product 41, money is deposited and change is provided in coin return 59 if necessary after the product selection is made.

The door 23 is provided with a window 61 that allows for viewing of the products 41 in the enclosure 13 as well as the product selection indicia. The window is positioned adjacent the upper portion of the door 23 extending downwardly therefrom providing consumer convenience for viewing the available products. The window 61 includes a transparent window pane 63 to permit product viewing and to secure the contents in the enclosure 13 from theft, tampering, etc. Such window panes can be made of tempered glass or break resistant polymeric material such as polycarbonate. Windows for the above described vending machines are typically large and occupy a substantial portion of the surface area of the door 23 leaving little space and/or good location for product advertising.

Vending machines of the above described type are well known as exemplified by Model 167 from Crane National Vendors of Bridgeton, Mo.

The above described vending machine 11 is adapted for dispensing shelf stable packaged ingestible food items such as chips, candy bars, chewing gum, crackers, etc. Alternately, the vending machine could also contain and dispense personal products such as pharmaceuticals, e.g., aspirin, personal hygiene products, novelties, etc. The vending machine may also be constructed to dispense refrigerated products such as beverages like soda, milk and other products such as sandwiches, fruit, etc. The vending machine of the present invention has particular applicability to vending branded products and particularly competing brands of products.

The vending machine 11 is provided with the access panel 47 movable by a consumer between open and closed positions and is shown closed in the Figures. In the past, the principal function of the access panel 47 was security, i.e., to prevent unauthorized access to the interior of the enclosure 13 and theft of product. In hot beverage dispensers, an access panel can also prevent splatter of hot liquid. The access panel 47 is pivotally mounted to the door 23 for movement between the open and closed positions and is biased to the closed position, e.g. by its own weight and the weight of additional security doors inside (not shown). The pivotal mount can be by pivot pins 77 secured to the access panel via screws 78 thru a plate 80 to which the pivot pins are attached. A shoulder 79 can also be provided to limit pivoting movement to the closed position by engaging an inner surface of the door 23.

Figure 3:
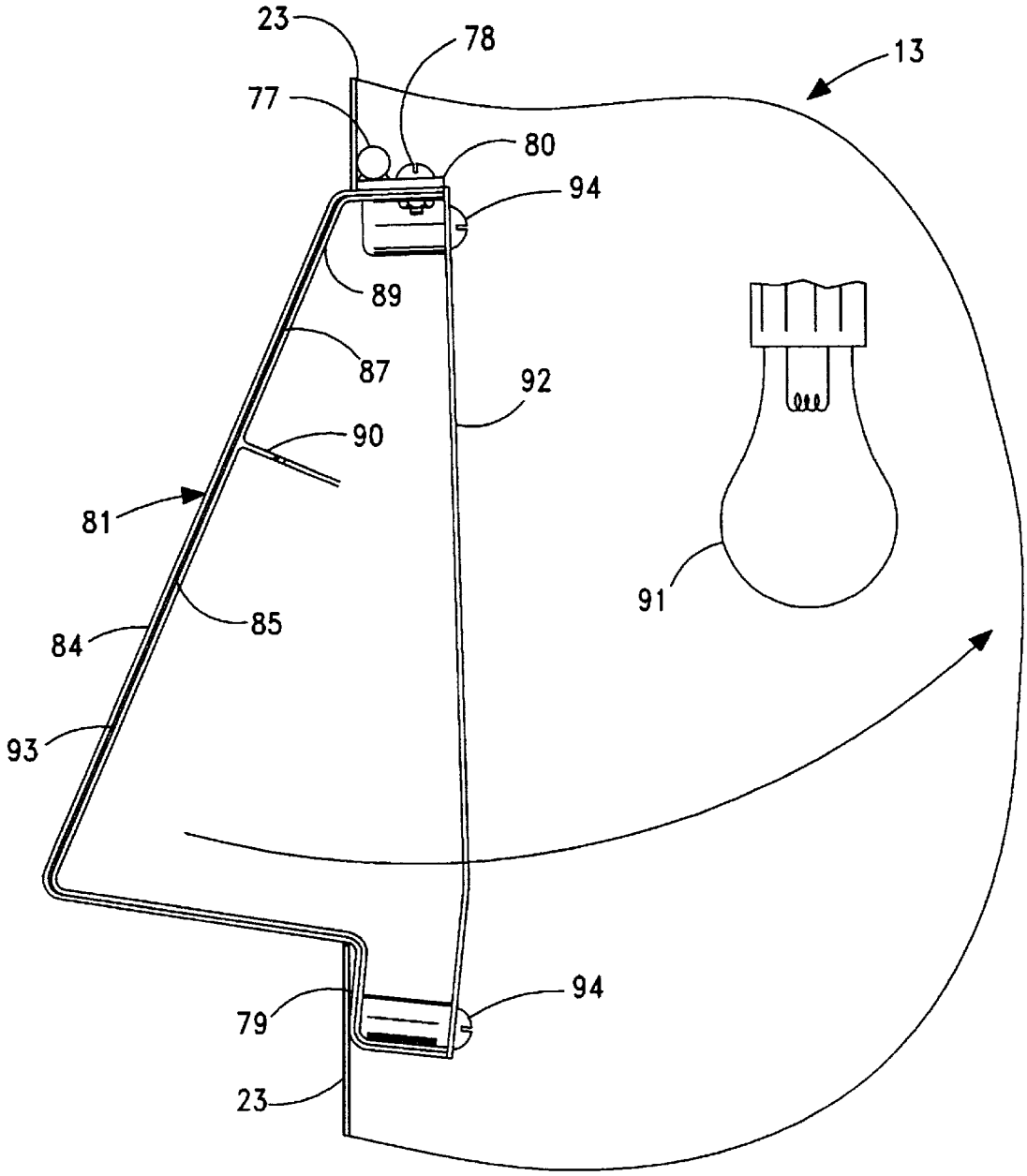
FIG. 3 is a section of the access panel of FIG. 2 taken along the line 3—3 of FIG. 2.

The access panel 47, as best seen in FIG. 3, includes a front panel portion 81 which permits viewing of advertising indicia 85 therethrough and can be either transparent or translucent so long as the indicia is discernible therethrough. The front panel 81 provides a viewing area 84 for the advertising indicia 85 which in a preferred embodiment is permanently applied to a back side (inside) 87 of the front panel. The viewing area 84 is a major portion of the exposed portion of the access panel 47. The layer of advertising indicia 85 is best seen in FIG. 3 where its thickness is enlarged and out of proportion, for clarity. The indicia 85 is applied in any suitable manner such as by pad printing or silk screen printing. Printing is preferably done on a relatively flat surface but can be done on a curved surface. A back panel 89 is secured to the front panel 81 encapsulating the indicia between the front and back panels. During formation of the access panel 47, the indicia 85 may fuse with or otherwise become part of the front and/or back panel and may no longer be a distinct layer as is illustrated. The back panel 89 may be opaque, translucent or transparent and can be provided with one or more strengthening ribs 90. A light 91 (FIG. 3) may be mounted in the enclosure 13 behind the access panel 47 for illumination of the access panel and the advertising indicia 85. A low heat output light would be preferred so as to not unduly heat the interior of the vending machine and the products therein. A back cover 92 may be secured as with fasteners 94 to the access panel 47. If the access panel is to be illuminated, the cover 92 would need to be translucent or transparent.

The front panel 81 may be formed to final shape before or after the application of the advertising indicia 85. If the front panel 81 is formed to shape after application of the indicia, the shapes of the indicia elements such as lettering or the like may be adjusted to compensate for the reshaping thereof during the forming to final shape of the front panel 81. The front panel 81 may start as a relatively flat panel and pressure formed, e.g., by vacuum forming, thermoforming or the like. When the advertising indicia 85 is applied to the back surface 87 of the viewing area 84 before forming the front panel to final shape, the majority of material of the front panel 81 is preferably kept above its melting temperature after application of the indicia. Some melting may occur on the back surface 87 when the molten material of the back panel 89 comes into contact therewith in one method of manufacture described below. A preferred material for the front panel is Lexan® polycarbonate. The front panel has thickness in the range of about 0.020 thru about 0.040 inches and preferably about 0.030 inches. The thickness may vary some across the access panel 47 if thermoformed because of material stretching. It is desirable to have the front panel 81 thin so as to not adversely affect the color or clarity of the advertising indicia 85. It is also desirable to have the access panel thick enough to be structurally sound against wear and tear that such panels encounter from use. The back panel 89 also protects the advertising indicia from damage during handling of the access panel 47 during such activities as machine assembly and maintenance. The use of the multiple layers will provide these attributes.

The back panel 89 has an interior surface 93 (relative to the access panel 47) that is generally the same contour as the back surface 87 (also an inside surface). The back panel 89 is secured to the front panel 81 with the advertising positioned therebetween. In a preferred embodiment, the back panel 89 is bonded to the front panel, e.g., by fusion. The formed front panel 81 may be inserted into the female side of a mold and a male side of the mold would be closed on the female side. Polymeric material, at temperature above its melting temperature, e.g., a polycarbonate, may then be injected into the mold cavity to fill the void on the back side 87 of the front panel 81 to thereby form the back panel 89 providing a monolithic structure. The injected molten material (viscous liquid) will fuse or bond to the back surface 87 even with the ink used to print the advertising indicia 85 already applied as an intervening layer. The back panel 89 has thickness in the range of about 0.080 thru about 0.120 inches and preferably about 0.100 inches. The front and back panels are an integral structure after bonding and encapsulate the advertising indicia therebetween making the indicia a permanent part or the access panel.

When the access panel 47 is mounted to the door 23 the outer surface of the viewing area 84 is at an angle A, when closed, in the range of about 0° thru about 45° and preferably in the range of about 0° thru about 15° relative to vertical (0° being vertical). If the outer surface is frosted or does not have a highly reflective surface, angle A may be within and/or outside this range. The access panel 47 is a relatively small portion of the door (front) 23 of the vending machine, i.e., less than about 25% and preferably less than about 10% of area of the door 23.

The access panel 47 can be made in the following manner. The front panel 81 can be made from a relatively flat sheet and formed to its final shape such as by thermoforming. Alternately, the outer panel 81 may be molded directly in its final form such as by injection molding. The advertising indicia 85 may be applied to the precursor flat sheet and the front panel 81 formed to its final shape thereafter. Alternately, the advertising may be applied to the front panel 81 after it is in its final shape. Application of the advertising indicia may be by any suitable printing method as described above. A suitable ink for the advertising indicia is UV stabilized high melting point thermoplastic resin based ink. The back panel 89 is then secured to the front panel 81. One method is as described above where the back panel is molded in place and is bonded to the front panel 81. Alternately, the back panel 89 may be formed to final shape and then secured to the front panel 81. Any suitable securement may be used, such as gluing or mechanical locking arrangements. The hinge pins 77 may then be secured to the access panel such as with mechanical fasteners as described above. The completed access panel is then mounted on the vending machine for movement between open and closed positions.

Figure 4:
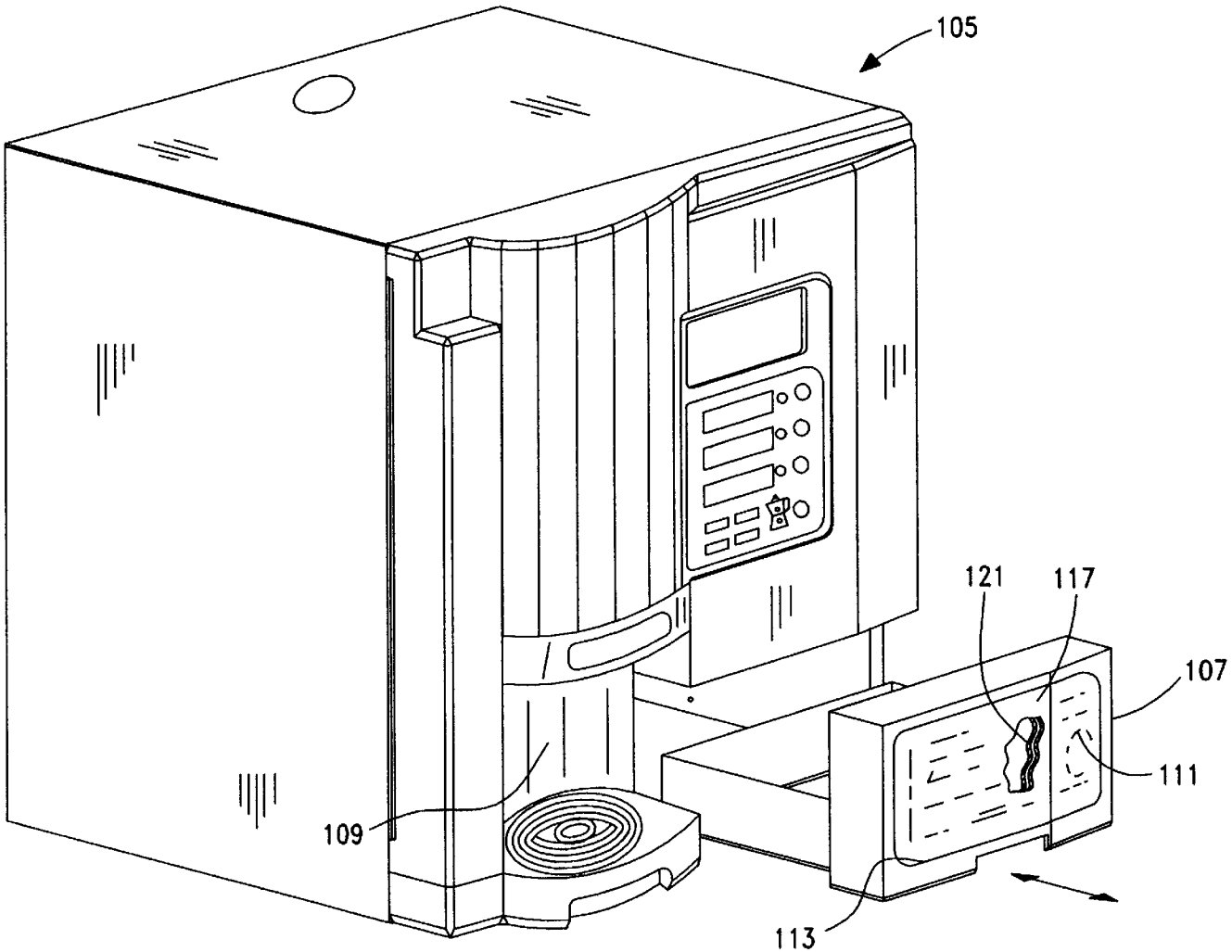
FIG. 4 is a perspective of an alternate embodiment of the invention showing a different form of vending machine and access panel with the access panel shown in a partially open position and with a portion broken away to show details thereof.

FIG. 4 shows an alternate embodiment of the access panel and is adapted for use with a vending machine 105 that uses a drawer type access panel 107. Such access panels can be used, e.g., with a coffee machine to provide access to clean the machine and, like the access panel 47, is located in proximity to a product retrieval area 109 for improving consumer attention to the advertising indicia. The access panel 107 is movably mounted to the vending machine 105 and can move linearly in and out in a generally horizontal plane or could be hinged for pivotal movement. The access panel 107 has advertising indicia 111 behind an outer surface 113 of a front panel 117 for viewing by a consumer during operation of the vending machine 105. Like the access panel 47, the access panel 107 has a back panel 121 secured to the front panel 117 encapsulating the advertising indicia in between (the thickness of the panels being exaggerated for clarity.

The access panels 47, 107 provide a means to advertise products on a vending machine without obscuring viewing of products for sale. The advertising is also tamper and wear resistant. The access panels 47, 107 can also be constructed to allow for easy changing of the advertising but only by authorized personnel. Even though the advertising indicia occupies a relatively minor portion of the front face of the vending machine it is located in a position where a consumer will readily view it while not being in the way of their viewing product for sale.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A vending machine for the dispensing of packaged products such as drinks, confections and food, said vending machine having a movable access panel providing access to an internal area of the machine by a person, the access panel being located such that a consumer is likely to view the access panel during operation of the machine, said vending machine comprising:

an enclosure securely enclosing product to be selectively purchased by a consumer, said enclosure having a front portion;

a plurality of feed mechanisms each operable to selectively dispense product to a product access area where the consumer can access the dispensed product for subsequent use;

a product selection device associated with the feed mechanisms and usable by the consumer to select the product desired for dispensing;

an access panel movable between closed and open positions adjacent said product access area, said panel having a portion visible in the closed position to a consumer, said panel having advertising indicia behind an outer disposed surface of the visible portion of the panel and viewable therethrough by a consumer when the panel is in its closed position, said access panel forming a minor portion of the front of the enclosure.

2. A vending machine as sent forth in claim 1 wherein the access panel includes an outer layer of transparent material with said advertising indicia being applied to an inner surface thereof.

3. A vending machine as set forth in claim 2 wherein said access panel includes an inner layer of material applied to the inner surface sealing the indicia between the inner and outer layers.

4. A vending machine as set forth in claim 3 wherein said outer layer is molded polymeric material and said inner layer is molded polymeric material.

5. A vending machine as set forth in claim 3 wherein outer layer and inner layer are bonded to one another.

6. A vending machine as set forth in claim 1 wherein said access panel is mounted for pivotal movement between the open and closed positions and prevents access to the product in the enclosure prior to dispensing and allowing access to product only after the product has been dispensed by the feed mechanism.

7. A vending machine as set forth in claim 6 wherein said access panel is mounted for pivotal movement about a generally horizontal axis.

8. A vending machine as set forth in claim 1 wherein said access panel is mounted for movement in a generally horizontal plane.

9. A vending machine as set forth in claim 8 wherein said access panel is the front panel of a drawer.

10. A vending machine as set forth in claim 1 wherein a substantial portion of said visible portion is at an angle in the range of about 0° thru about 45° from vertical when said access panel is in the closed position.

11. A method of forming an access panel for a vending machine, said vending machine including an enclosure having a front portion, comprising:

forming an outer panel of material that allows viewing therethrough, said outer panel having an outer surface and an inner surface and a contour;

applying advertising indicia to at least a portion of the inner surface;

forming an inner panel and securing it in overlying relation to the advertising indicia thereby to have said advertising indicia between the inner and outer panels;

positioning said outer and inner panels with respect to said front portion so that the access panel forms a minor portion of said front portion; and positioning said outer and inner panels for access to at least one dispensed product dispensed from a plurality of feed mechanisms.

12. A method as set forth in claim 11 wherein said advertising indicia is applied prior to forming the contour of the outer panel.

13. A method as set forth in claim 12 including bonding the inner panel to the outer panel encapsulating the advertising indicia therebetween.

14. A method as set forth in claim 11 including forming access panel mounting means as part of the inner panel.

15. A method as set forth in claim 11 wherein the outer panel is pressure formed at a temperature below the melting point of the outer panel.

16. A method as set forth in claim 15 wherein the inner panel is pressure formed at a temperature above the melting point of the inner panel.

17. A method as set forth in claim 16 wherein the inner panel is secured to the outer panel by fusion.

18. A method as set forth in claim 11 wherein said outer panel includes a main viewing area with at least a portion of the advertising indicia therebehind and viewable therethrough, the main viewing area is positioned such that when the access panel is mounted on a vending machine and in a closed position, the viewing area will have a substantial portion thereof at an angle in the range of about 0° thru about 45° from vertical.

19. An access panel for use with a vending machine and adapted for displaying advertising indicia to consumers, said vending machine including an enclosure having a front portion, said access panel comprising:

a front panel with a viewing area having inner and outer surfaces, said viewing area being at least one of transparent and translucent;

advertising indicia on said inner surface and visible through said viewing area;

a back panel having an inner surface adjacent the inner surface of the front panel surface with the advertising indicia therebetween; and said access panel forming a minor portion of said front portion and in operable engagement with at least one dispensed product dispensed from a plurality of feed mechanisms.

20. An access panel as set forth in claim 19 wherein the back panel is bonded to the front panel.

21. An access panel as set forth in claim 20 wherein the front and back panels are comprised of polymeric material and are fused together at the inner surfaces encapsulating the advertising indicia.

22. An access panel as set forth in claim 21 wherein the back panel is molded to the front panel.

* * * * *